US007003957B2

(12) United States Patent
Griffin et al.

(10) Patent No.: US 7,003,957 B2
(45) Date of Patent: Feb. 28, 2006

(54) BURNER FOR SYNTHESIS GAS

(75) Inventors: Timothy Griffin, Ennetbaden (CH); Albert Keller, Neuenhof (CH); Joachim Krautzig, Widen (CH); Roland Mücke, Windisch (CH); Frank Reiss, Lauchringen (DE)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 10/826,326

(22) Filed: Apr. 19, 2004

(65) Prior Publication Data

US 2004/0226297 A1 Nov. 18, 2004

Related U.S. Application Data

(63) Continuation of application No. PCT/IB02/04061, filed on Oct. 2, 2002.

(30) Foreign Application Priority Data

Oct. 19, 2001 (DE) ..... 101 52 700
Feb. 19, 2002 (CH) ..... 0285/02

(51) Int. Cl.
*F23R 3/30* (2006.01)

(52) U.S. Cl. ..... 60/737; 60/740

(58) Field of Classification Search ..... 60/737, 60/738, 740, 748, 750, 804
See application file for complete search history.

(56) References Cited

U.S. PATENT DOCUMENTS

| | | | | |
|---|---|---|---|---|
| 2,515,843 A | | 7/1950 | te Nuyl | 158/1.5 |
| 4,932,861 A | | 6/1990 | Keller et al. | 431/8 |
| 5,150,570 A | * | 9/1992 | Shekleton | 60/804 |
| 5,177,955 A | * | 1/1993 | Shekleton | 60/804 |
| 5,375,995 A | | 12/1994 | Döbbeling et al. | 431/8 |
| 5,735,687 A | | 4/1998 | Knöpfel et al. | 431/354 |
| 5,778,676 A | | 7/1998 | Joshi et al. | 60/746 |
| 5,983,642 A | * | 11/1999 | Parker et al. | 60/737 |
| 6,456,634 B1 | | 9/2002 | Cremer | 372/29.01 |
| 6,632,084 B1 | | 10/2003 | Berenbrink | 431/284 |

FOREIGN PATENT DOCUMENTS

| | | |
|---|---|---|
| DE | 198 55 034 A1 | 5/2000 |
| DE | 200 09 525 U1 | 10/2000 |
| EP | 0 321 809 B1 | 6/1989 |
| EP | 0 610 722 A1 | 8/1994 |
| EP | 0 780 629 A2 | 6/1997 |
| EP | 1 070 915 A1 | 1/2001 |
| EP | 1 070 950 A2 | 1/2001 |
| GB | 2 345 958 A | 7/2000 |
| WO | WO 93/17279 | 9/1993 |
| WO | WO 00/12936 | 3/2000 |

* cited by examiner

*Primary Examiner*—Louis J. Casaregola
(74) *Attorney, Agent, or Firm*—Steptoe & Johnson LLP

(57) ABSTRACT

The present invention relates to a burner, substantially comprising a swirl generator for a combustion air stream and means for introducing fuel into the combustion air stream, the swirl generator having combustion-air inlet openings for the combustion air stream that enters the burner, and the means for introducing fuel into the combustion air stream comprising one or more first fuel feeds having a group of first fuel outlet openings, arranged distributed around the burner axis at a combustion chamber-side end of the burner. The burner is distinguished by the fact that the one or more first fuel feeds having the group of first fuel outlet openings are mechanically decoupled from the swirl generator. The present burner allows reliable and safe use of synthesis gas in both dilute and undiluted form as fuel.

19 Claims, 6 Drawing Sheets

BURNER FOR SYNTHESIS GAS

CROSS-REFERENCE TO RELATED APPLICATIONS

This application is a continuation of the U.S. National Stage designation of co-pending International Patent Application PCT/IB02/04061 filed Oct. 2, 2002, the entire content of which is expressly incorporated herein by reference thereto.

FIELD OF THE INVENTION

The present invention relates to a burner, for operation in a combustion chamber, preferably in combustion chambers of gas turbines, which substantially comprises a swirl generator for a combustion air stream and means for introducing fuel into the combustion air stream, the swirl generator having combustion-air inlet openings for the combustion air stream which enters the burner, and the means for introducing fuel into the combustion air stream comprising one or more first fuel feeds having a group of first fuel outlet openings, arranged distributed around the burner axis at a combustion chamber-side end of the burner. A preferred application area for a burner of this type is in gas and steam turbine engineering.

BACKGROUND OF THE INVENTION

EP 0 321 809 B1 has disclosed a conical burner comprising a plurality of shells, known as a double-cone burner. The conical swirl generator, which is composed of a plurality of shells, generates a continuous swirling flow in a swirl space, which on account of the swirl increasing in the direction of the combustion chamber becomes unstable and changes into an annular swirling flow with backflow in the core. The shells of the swirl generator are assembled in such a manner that tangential air inlet slots for combustion air are formed along the burner axis. Feeds for the premix gas, i.e. the gaseous fuel, which have outlet openings for the premix gas distributed along the direction of the burner axis, are provided at these air inlet slots at the leading edge of the cone shells. The gas is injected through the outlet openings or bores transversely with respect to the air inlet gap. This injection, in conjunction with the swirl of the combustion air/fuel gas flow generated in the swirl space, leads to thorough mixing of the combustion or premix gas with the combustion air. Thorough mixing is a precondition in these premix burners for lower $NO_x$ emissions during combustion.

To further improve a burner of this type, EP 0 780 629 A2 has disclosed a burner for a heat generator which, following the swirl generator, has an additional mixing section for further mixing of fuel and combustion air. This mixing section may, for example, be designed as a section of tube which is connected downstream and into which the flow emerging from the swirl generator is transferred without significant flow losses. The additional mixing section makes it possible to further increase the degree of mixing and therefore to further lower the pollutant emissions.

WO 93/17279 has described a further known premix burner, in which a cylindrical swirl generator with a conical inner body is used. In the case of this burner, the premix gas is likewise injected into the swirl space via feeds with corresponding outlet openings which are arranged along the axially running air inlet slots. In the conical inner body, the burner additionally has a central feed for fuel gas, which can be injected into the swirl space close to the burner outlet for pilot control. The additional pilot stage is used to start up the burner and to widen the operating range.

EP 1 070 915 A1 has disclosed a premix burner in which the fuel gas supply is mechanically decoupled from the swirl generator. As a result, when fuel gases that have not been preheated or have been only slightly preheated are used, stresses caused by thermal expansions are avoided. In this case, the swirl generator is provided with a row of openings, through which fuel lines for gas premix operation, which are mechanically decoupled from the swirl generator, project into the interior of the swirl generator, where they supply gaseous fuel to the swirled-up flow of combustion air.

These known premix burners of the prior art are what are known as swirl-stabilized premix burners, in which a fuel mass flow, prior to combustion, is distributed as homogeneously as possible in a combustion air mass flow. In these types of burners, the combustion air flows in via tangential air inlet slots in the swirl generators. The fuel, in particular natural gas, is typically injected along the air inlet slots.

In gas turbines, in addition to natural gas and liquid fuel, generally diesel oil or Oil#2, in recent times synthetically produced gases, known as Mbtu and Lbtu gases, also have been used for combustion. These synthesis gases are produced by the gasification of coal or oil residues. They are characterized by mostly comprising $H_2$ and CO. In addition, there is a smaller proportion of inert constituents, such as $N_2$ or $CO_2$.

In the case of the combustion of synthesis gas, the injection which has proven successful for natural gas in burners of the prior art cannot be retained, on account of a high risk of flashback.

This results in the following peculiarities and requirements in a burner that is to be operated with synthesis gas as distinct from a burner using natural gas. Depending on the dilution of the synthesis gas, which is known per se from the prior art, synthesis gas requires a fuel volumetric flow which is around four times—and in the case of undiluted synthesis gas up to seven times or even more—higher than comparable natural gas burners, so that with the same gas holes in the burner, significantly different pulse ratios result. On account of the high hydrogen content in the synthesis gas, and the associated low ignition temperature and high flame velocity of the hydrogen, the fuel is highly reactive, so that in particular the flashback characteristics and the residence time of ignitable fuel-air mix in the vicinity of the burner need to be investigated. Furthermore, stable and safe combustion of synthesis gases for a sufficiently wide range of calorific values has to be ensured, despite the synthesis gas having different compositions depending on the process quality of the gasification and starting product, for example oil residues. In order, under these conditions, nevertheless to achieve premixing and therefore the typical lower emissions during combustion, these synthesis gases are generally diluted with the inert constituents $N_2$ or steam prior to combustion. Moreover, this improves the stability of combustion and in particular reduces the risk of flashback which is inherent to the high $H_2$ content. Therefore, the burner has to be able to safely and stably burn synthesis gases of different compositions, in particular of different dilutions.

Furthermore, it is advantageous if, in addition to the synthesis gas, the burner can also safely burn a reserve fuel, known as a back-up fuel. In the case of the highly complex integrated gasification combined cycle (IGCC) installation, this requirement results from the demand for high availability. In such a situation, the burner should function safely and reliably even in mixed operation using synthesis gas and back-up fuel, for example diesel oil, while maximizing the fuel mix spectrum that can be used for burner operation in mixed operation of an individual burner. Of course, low levels of emissions ($NO_x \leqq 25$ vppm, $CO \leqq 5$ vppm) should be ensured for the fuels which are specified and used.

EP 0 610 722 A1 has disclosed a double-cone burner, in which a group of fuel outlet openings for a synthesis gas are arranged at the swirl generator, distributed around the burner axis, at a combustion chamber-side end of the burner. These outlet openings are supplied via a separate fuel line and allow the burner to operate with undiluted synthesis gas.

Working on the basis of this prior art, the present invention relates to a burner which ensures safe and stable combustion both for undiluted synthesis gas and for dilute synthesis gas and moreover has a long service life. The burner should in particular satisfy the requirements listed above and, in preferred refinements, should allow operation with a plurality of types of fuel, including in mixed operation.

SUMMARY OF THE INVENTION

The present burner comprises, in a known way, a swirl generator for a combustion air stream and means for introducing fuel into the combustion air stream. The swirl generator has combustion-air inlet openings for the combustion air stream, which preferably enters the burner tangentially. The means for introducing fuel into the combustion air stream comprise one or more first fuel feeds having a group of first fuel outlet openings, arranged distributed around the burner axis at a combustion chamber-side end of the burner, i.e. at the burner outlet. The present burner is distinguished by the fact that the one or more first fuel feeds having the group of first fuel outlet openings are mechanically decoupled from the swirl generator.

The geometry of the swirl generator, and also of an optional swirl space, can be selected in various ways in the present burner, and in particular may have the geometries which are known from the prior art. The fact that the first fuel outlet openings are distributed exclusively at the combustion chamber-side end of the burner or swirl space, around the burner axis, reliably prevents flashback of the synthesis gas. Mixing with the combustion air emerging from the burner is nevertheless ensured. Synthesis gas with a high hydrogen content (45% by volume) can be burnt in undiluted form (LHV=14,000 kJ/kg). The burner therefore allows safe and stable combustion both of undiluted synthesis gas and of dilute synthesis gas. This ensures a high degree of flexibility when using a gas turbine equipped with burners according to the invention in an IGCC process. By using a configuration of the first fuel feed with a correspondingly adapted cross-section, it is possible to safely pass high volumetric flows, up to a factor of 7 compared to the supply of natural gas in known burners from the prior art, to the location of injection at the burner outlet.

In the case of the present burner, the one or more first fuel feeds with the associated first fuel outlet openings are mechanically and thermally decoupled from the swirl generator or the burner shells which form the swirl generator and are significantly warmer in operation. As a result, the thermal stresses between the relatively cold first fuel feeds, also referred to below as gas passages, and the warmer burner shells are avoided or at least greatly reduced. For example, in one embodiment of the present invention, as is explained in more detail in the exemplary embodiments, the injection area for the synthesis gas in the burner shells is completely cut out. The first gas passage is directly anchored in this cutout of the burner shells. As a result, gas passage and burner shells are thermally and mechanically decoupled from one another, and the design problem at the connecting locations between cold gas passage and warm burner shell is resolved. Earlier designs, such as those shown in EP 0 610 722 A1, had problems particularly with regard to the connection of relatively cold gas passage to hot burner shell, for example had cracked resulting from the high concentration of stresses at these connecting locations. The required service life of the burner is achieved by the decoupled solution and the proposed design.

The decoupling of individual fuel lances from the burner shells is already known from EP 1 070 915. In the present burner, however, this mechanical decoupling is for the first time realized using integral gas passages with circumferentially homogeneous introduction of gas. Compared to the injection of gas which is known from EP 1 070 950, the circumferentially homogeneous injection of gas in accordance with the invention has benefits in terms of achieving a significantly more uniform distribution of the fuel in the combustion air, and therefore, in particular when using Lbtu and Mbtu fuels, improved emission levels combined, at the same time, with a good flame stability. There is no need for complex specific heat insulation for the gas passage with respect to the hot burner shell, for example by means of the known gas passage inserts.

It is preferable for the burner, in addition to the first fuel feed(s), also to have one or more second fuel feeds having a group of second fuel outlet openings at the swirl body, arranged substantially along the direction of the burner axis. As an alternative or in combination with this measure, it is also possible to provide a fuel lance, arranged on the burner axis, for the injection of liquid fuel, this fuel lance projecting into the swirl space in the axial direction. The arrangement and configuration of these additional fuel feeds may, for example, be based on known premix burner technology as described in EP 321 809 or on other designs, for example as disclosed by EP 780 629 or WO 93/17279. Burner geometries of this type can be designed with the features according to the invention for the combustion of synthesis gases, in particular for the combustion of Mbtu and Lbtu fuels.

The preferred design of the present burner with one or more further fuel feeds results in a multifunctional burner which safely and stably burns a very wide range of fuels. The burner in particular ensures the stable and safe combustion of Mbtu synthesis gases with calorific values (net calorific value NCV or lower heating value LHV) of 3500–18,000 kJ/kg, in particular 6000 to 15,000 kJ/kg, preferably of 6500 to 14,500 kJ/kg or from 7000 to 14,000 kg/kJ. In addition to the safe and stable combustion of undiluted and dilute synthesis gas, it is also possible to use liquid fuel, for example diesel oil, as back-up fuel. In this case, the calorific value of the fuels used may differ significantly, for example in the case of diesel oil a calorific value LHV=42,000 kJ/kg, and in the case of synthesis gas a calorific value of 3500–18,000 kJ/kg, in particular 6000 to 15,000 kJ/kg, preferably from 6500 to 14,500 kJ/kg or from 7000 to 14,000 kg/kJ.

It is also possible for the additional fuel used to be natural gas. In this case, the injection of natural gas may take place either in the burner head through the burner lance and/or via the second fuel feeds, which are usually formed by the gas passages arranged along the air inlet slots at the swirl generator or swirl body, with which the person skilled in the art will be familiar, for example from EP 321 809. In this way, the burner can be operated with three different fuels.

The injection of the synthesis gas, i.e. of the Lbtu/Mbtu fuel, takes place via the first outlet openings, radially at the burner outlet. These outlet openings are small outlet passages, the passage axis of which defines the axial injection angle α. Diameter D and injection angle α of these outlet openings or passages are specific parameters which can be selected appropriately by the person skilled in the art depending on the boundary conditions, for example the specific gas composition, the emissions, etc. The injection angle may in this case be selected in such a way that the passage axes of all the outlet openings intersect at one point on the burner axis, downstream of the burner or swirl space. To achieve optimum matching of the synthesis gas used to the desired emission levels, it is also possible for the injection angles to be selected in such a way that the passage axes of subgroups of the outlet openings intersect at different points. In this way, it is possible to achieve any desired distribution of the injected fuel at the burner outlet. It is also possible to vary an injection angle with respect to the burner radius.

The fuel feeds for combustion of the synthesis gas are designed for a volumetric flow of fuel which is up to 7 times greater, and in particular provide the required cross-sections of flow. In this case, the cross-section is larger by a multiple than that of the feeds for natural gas.

In the case of oil being used as fuel, the design which is known from the prior art, with the oil or oil-water emulsion being injected via the burner lance, is retained. Gas turbines which burn synthesis gas have to ensure mixed operation of ignition fuel and synthesis gas by using different boundary conditions, such as incorporation of the gas turbine in the IGCC process or fixed burner groupings that are to be retained. The burner described here functions stably and safely even in mixed operation using diesel oil and synthesis gas in various mixing ratios. It can be safely operated in mixed operation for prolonged periods of time. Therefore, the gas turbine achieves further flexibility and in operation can change from one fuel to the other. The possibility of mixed operation represents a significant operating advantage.

BRIEF DESCRIPTION OF THE DRAWINGS

The present invention is explained briefly below, without restricting the general concept of the invention, with reference to exemplary embodiments in conjunction with the figures, in which.

DETAILED DESCRIPTION OF THE PREFERRED EMBODIMENTS

Figure 1:
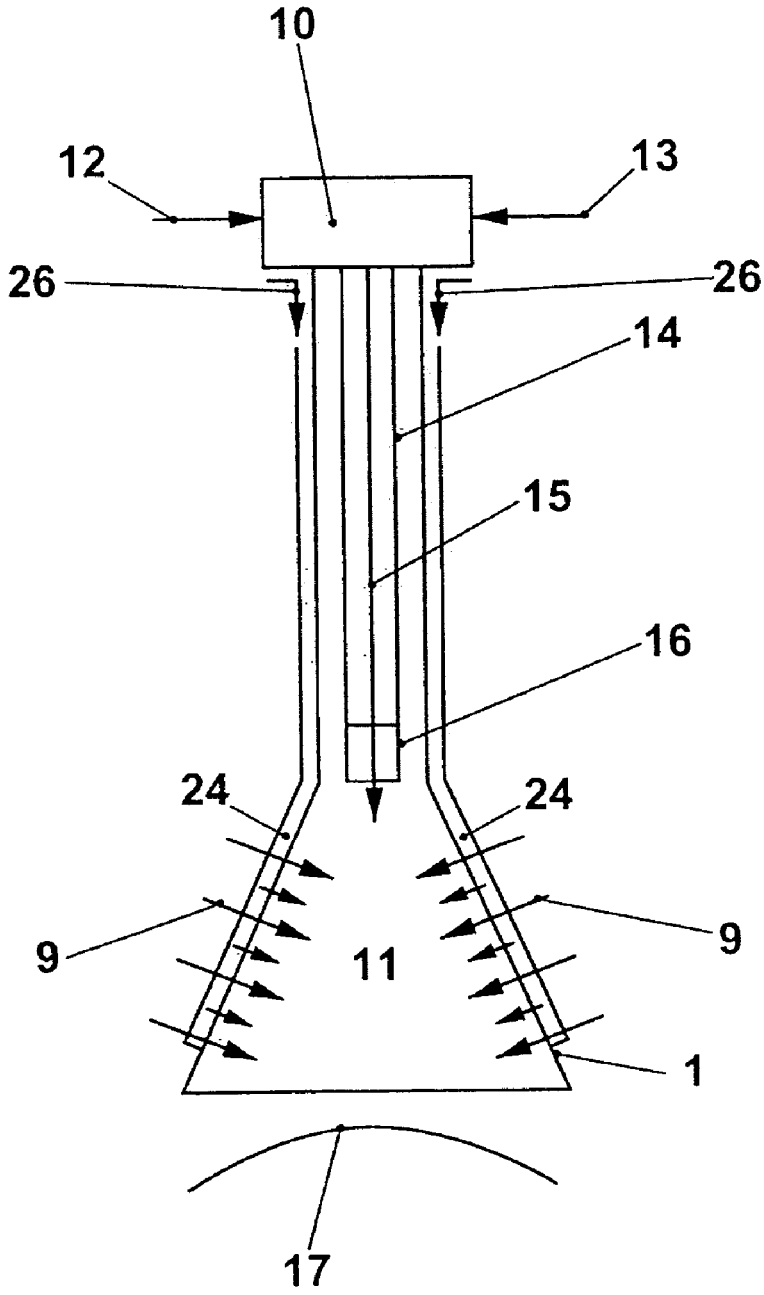
FIG. 1 shows a highly diagrammatic illustration of a premix burner as is known from the prior art.

FIG. 1 shows a highly diagrammatic illustration of a premix burner as is known, for example, from EP 321 809 A1. The burner is composed of a burner head 10 and an adjoining swirl generator 1, which forms a swirl space 11. In a burner of this type, the conical swirl generator 1 comprises a plurality of burner shells, between which tangential inlet slots for combustion air 9 are formed. In the figure, the combustion air 9 which enters is indicated by the long arrows. Furthermore, gas feeds 24 for the supply of a fuel, in particular natural gas 26, via the tangential air inlet slots leading into the swirl space 11 can be provided along the tangential inlet slots. This is indicated by the short arrows in the figure. A burner lance 14 extends from the burner head 10 into the swirl space 11; a nozzle 16 for the injection of liquid fuel 13, e.g. oil and/or water 12, is provided at the end of this burner lance 14. The burner lance 14 is used in particular for ignition of the burner. The combustion air 9 which enters via the tangential air inlet slots at the swirl generator 1 is mixed with the injected fuel in the swirl space 11. The continuous swirling flow which is generated in the process becomes unstable on account of the increasing swirl at the end of the swirl space 11 on account of the sudden widening in cross section at the transition to the combustion chamber, and is converted into an annular swirling flow with back flow in the core. This area forms the start of the reaction zone 17 in the combustion chamber.

A burner of this type cannot be operated with synthesis gas, however, on account of the high risk of flashback with this fuel.

Figure 2:
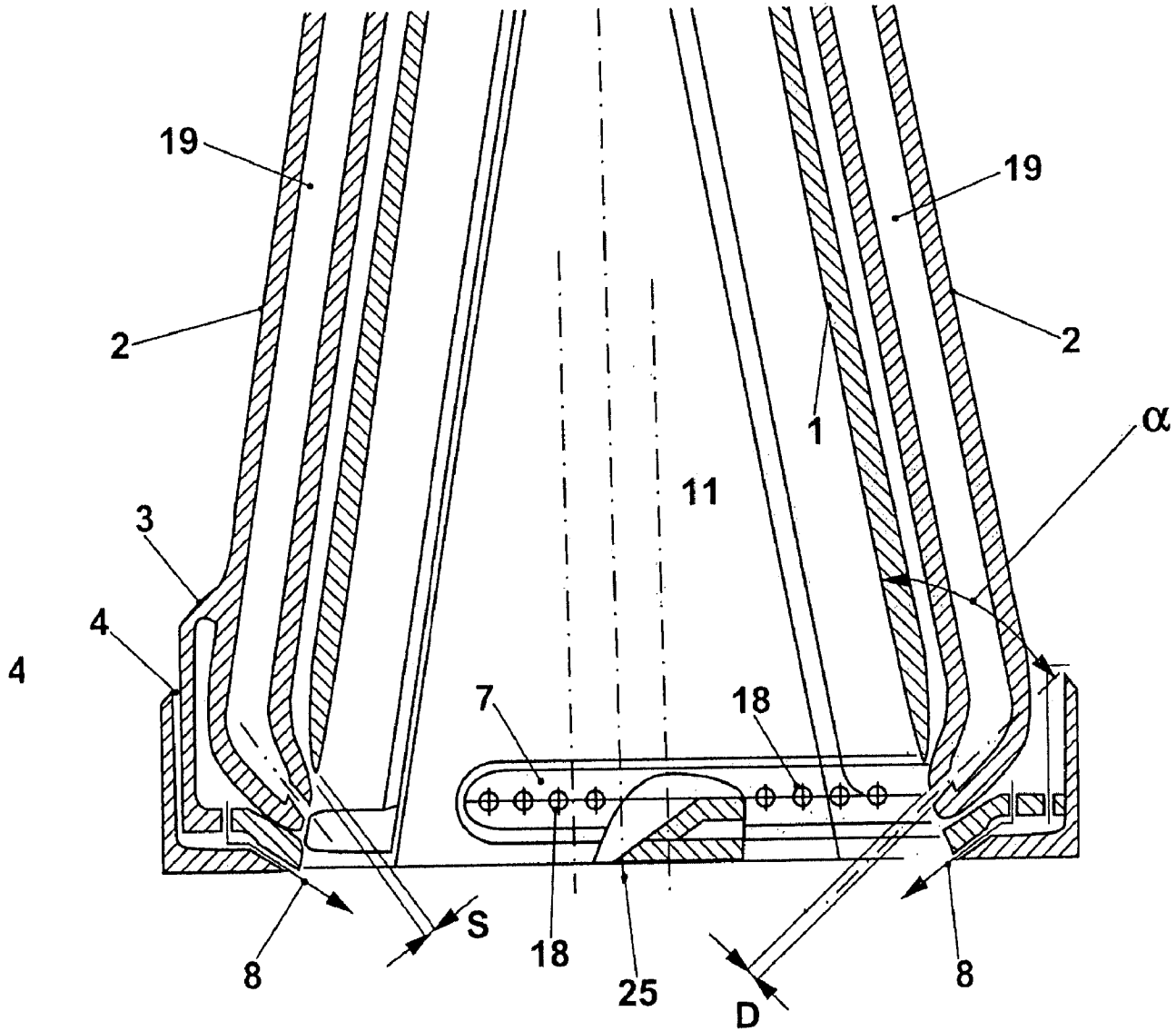
FIG. 2 shows a sectional view of the combustion chamber-side region of a burner in accordance with an exemplary embodiment of the present invention.

In a first exemplary embodiment, FIG. 2 shows a sectional view through the combustion chamber-side region of a burner according to the invention for operation with synthesis gas. The Lbtu/Mbtu fuel is injected through gas holes 18, which are to be selected appropriately in terms of diameter D and injection angle α, in the radial direction at the burner outlet, i.e. at the end of the swirl space 11. This radial injection at the burner outlet also makes combustion of the hydrogen-rich synthesis gas in undiluted form possible. Diameter D and injection angle α of the radial gas injection are specific parameters which are selected appropriately by the person skilled in the art depending on boundary conditions (specific gas composition, emissions, etc.).

In this context, the figure shows the burner shells of the swirl body 1 which surround the swirl space 11. Outside this swirl body there is arranged a gas feed element 2 which radially surrounds the swirl body 1 and forms the first fuel feed passage(s) 19 for the supply of the synthesis gas. First outlet openings 18 for the synthesis gas are formed at the combustion chamber-side end of this gas feed element 2. These outlet openings 18 form outlet passages which predetermine the direction of injection of the synthesis gas. The injection angle α and the diameter D of these passages or openings 18 are selected appropriately by the person skilled in the art depending on the particular requirements. In the present example, the outlet openings 18 are arranged in a row around the burner axis 25, so that circumferentially homogeneous injection of the synthesis gas is achieved.

The relatively cold fuel feed passages 19 for injection of the synthesis gas, and the in theory significantly warmer burner shells of the swirl generator 1 are thermally and mechanically decoupled from one another. As a result, the thermal stresses are significantly reduced. The connection between the gas feed element 2 and the swirl generator 1 is in this example effected by means of lugs 3 and 4 which are provided on both components and are connected to one another. This minimizes thermal stresses. An air flow 8 which is also illustrated in the figure tends to stabilize the flame and generates a swirl cooling effect at the burner front upstream of the outlet. The figure also shows the opening or circumferential gap 7 of the swirl generator 1, which is required in order to allow a connection between the outlet openings 18 of the gas feed element 2 and the swirl space 11.

FIG. 3 once again shows a burner designed in accordance with FIG. 2, in a three-dimensional sectional view. In this illustration too, the swirl generator 1 formed from a plurality of burner shells, and the gas feed element 2 surrounding it, can be seen. This gas feed element 2 may form an annular feed slot as fuel feed passage 19 or may also be divided into separate fuel feed passages 19. Of course, it is also possible for individual pipelines to be routed to the outlet openings 18 as fuel feed passages 19.

Figure 3:
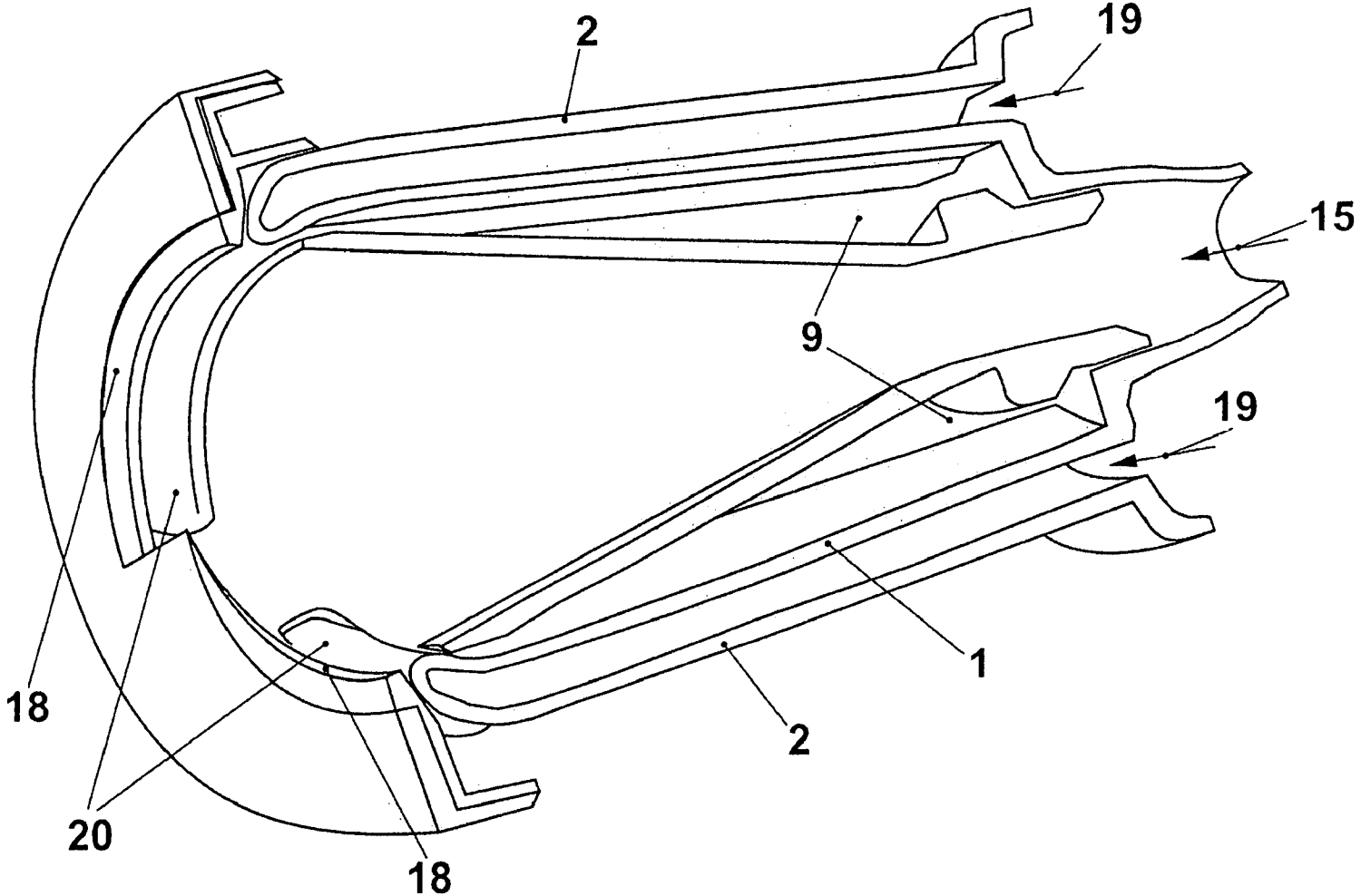
FIG. 3 shows a three-dimensional sectional view of a burner designed in accordance with the exemplary embodiment shown in FIG. 2.

The design of the fuel feed passages 19 for the synthesis gas is adapted for a volumetric flow of fuel which is up to 7 times greater for the combustion of synthesis gas, and in particular provide the required large cross sections of flow, as can be seen from FIG. 3.

In the present example, the injection region for the fuel, i.e. the synthesis gas, is completely cut out in the burner shells. In this case, the gas feed element 2 is anchored directly in this cutout of the burner shells of the swirl generator 1. In this way, the problem of stresses at the connecting locations between cold gas feed element 2 and warm burner shell is solved. The decoupled solution illustrated in this example results in the required service life of the burner.

The injection of the synthesis gas is indicated by reference numeral 20 in the figure. Of course, with a burner of this type, it is also possible for additional gas injection passages 24 to be provided along the swirl generator 1, in a similar way as can be seen, for example, from FIG. 1, by means of which passages, by way of example, natural gas 26 can be introduced into the swirl space 11 upstream of the location where the synthesis gas is injected. The injection of oil or an oil-water emulsion is diagrammatically indicated at the combustion head-side end of the swirl space 11, as is the incoming flow of combustion air 9 via the tangential inlet slots.

Figure 4:
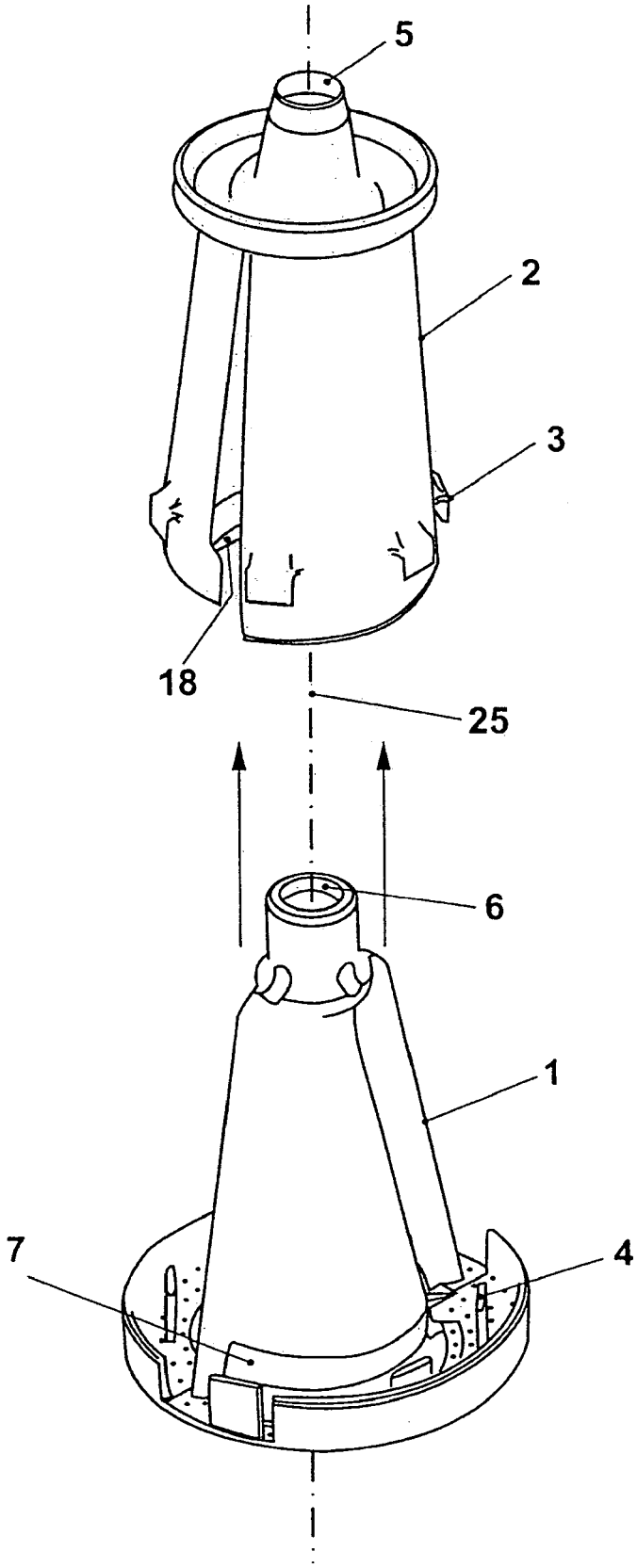
FIG. 4 shows an example of the mounting of a burner as shown in FIGS. 2 and 3.

FIG. 4 shows, by way of example, the assembly of a burner as shown in FIGS. 2 and 3 from the two components, namely the gas feed element 2 and the swirl generator 1.

The gas feed element 2 with the integrated one or more fuel feed passages 19 for synthesis gas and the outlet openings 18 arranged distributed around the burner axis 25 on the combustion chamber side is preferably produced as a casting together with the swirl generator 1, and the two components are then separated. Assembly is carried out by the swirl generator 1 being introduced axially into the gas feed element 2, so that the outlet openings 18 of the gas feed element 2 come to lie in corresponding openings 7 in the swirl generator 1. In the burner head region, an element 6 of the swirl generator 1 is held in a sliding fit in a mating piece 5 of the gas feed element 2, so that differential thermal expansions between swirl generator 1 and gas feed element 2 in the region of the burner head can be freely compensated for. In the region of the burner front, the connecting lugs 3 of the gas feed element 2 and the connecting lugs 4 of the swirl generator 1 are joined to one another in a suitable way, for example by welding, and form the only fixed bearing of the swirl generator 1 in the gas feed element 2. The outlet opening region of the gas feed element 2 can move freely in the openings 7 in the swirl generator 1. Producing the two elements from a casting allows minor manufacturing tolerances, so that it is possible to minimize an encircling gap dimension s, illustrated in FIG. 2, between swirl generator 1 and gas feed element 2. A correspondingly high mating accuracy with a small gap dimension s in the region of the gas outlet openings 18 and/or the openings 7 in the swirl generator 1 minimizes any unswirled combustion air emerging through this gap, which could potentially have adverse effects on the stability of combustion.

FIG. 5 shows various examples for differently selected injection directions of the first outlet openings 18 at the end of the swirl space 11 for the synthesis gas. In this context, FIG. 5*a* shows a greatly simplified illustration of a plan view of the burner outlet and the injection axes of the synthesis gas injection 20 from the individual outlet openings 18, which intersect one another at an intersection point 21 on the burner axis.

Figure 5A:
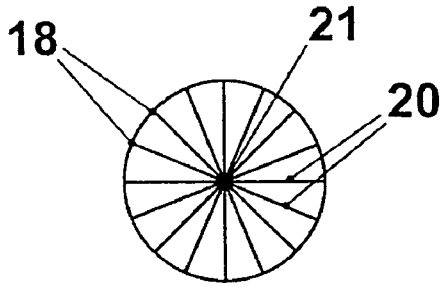
FIG. 5 shows a highly diagrammatic plan view of a plurality of different injection geometries for synthesis gas in the burner according to the invention.
Figure 5B:
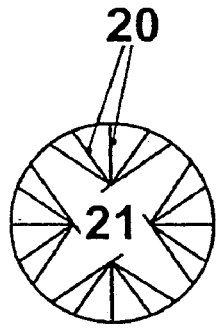

FIG. 5*b* shows a further exemplary embodiment, in the same view, in which the outlet axes of the synthesis gas injection 20 of different groups of outlet openings 18 intersect at different intersection points 21 which are distributed over the outlet cross section of the burner. It will be readily understood that the distribution of these intersection points 21 can be selected as desired in order to adapt the injection to the prevailing conditions. This is true firstly of the position of the intersection points 21 and secondly, of course, of the number of such points.

Figure 5C:
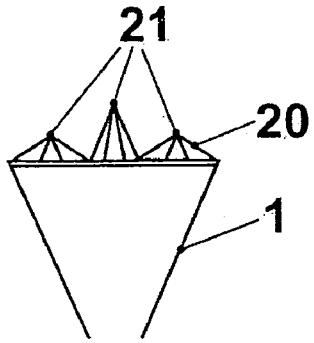
Figure 5D:
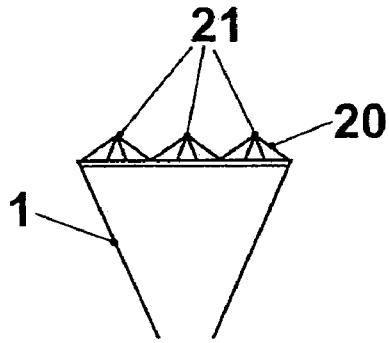

In the same way, it is possible for the intersection points 21 to be selected to lie at different distances from the outlet plane of the burner, or at the same distance from this plane, as is diagrammatically illustrated in FIGS. 5*c* and 5*d*.

Figure 6:
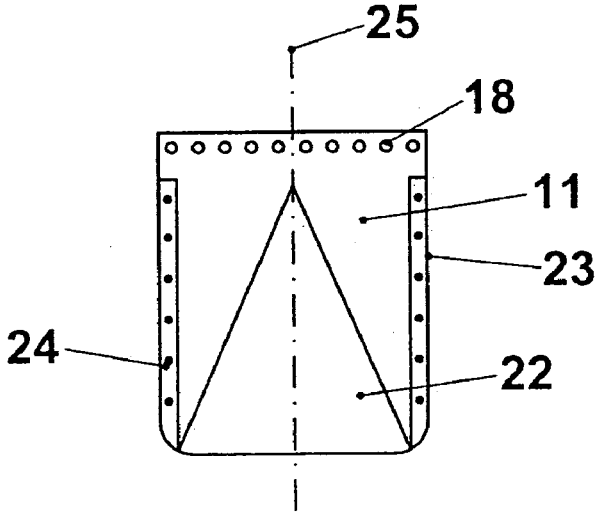
FIG. 6 shows an example of a possible configuration of the burner with a conical inner body.

FIG. 6 shows an example of a swirl generator 1 with a purely cylindrical swirl body 23, into which a conical inner body 22 is inserted. In this case, the pilot fuel can be supplied directly to the tip of the conical inner body 22. In this case too, the outlet openings 18 for the synthesis gas are arranged distributed around the burner axis 25 at the combustion chamber-side end of the swirl space 11. The fuel feed passages 19 are not shown in this illustration. In this case too, it is additionally possible for further gas outlet openings for natural gas, including the feed lines 24 required for this purpose, to be provided at the tangential air inlet slots (not shown). Furthermore, in this exemplary embodiment, as in the exemplary embodiments described above, a mixer tube for generating an additional mixing section may follow the swirl generator 1, as is known from the prior art.

Figure 7:
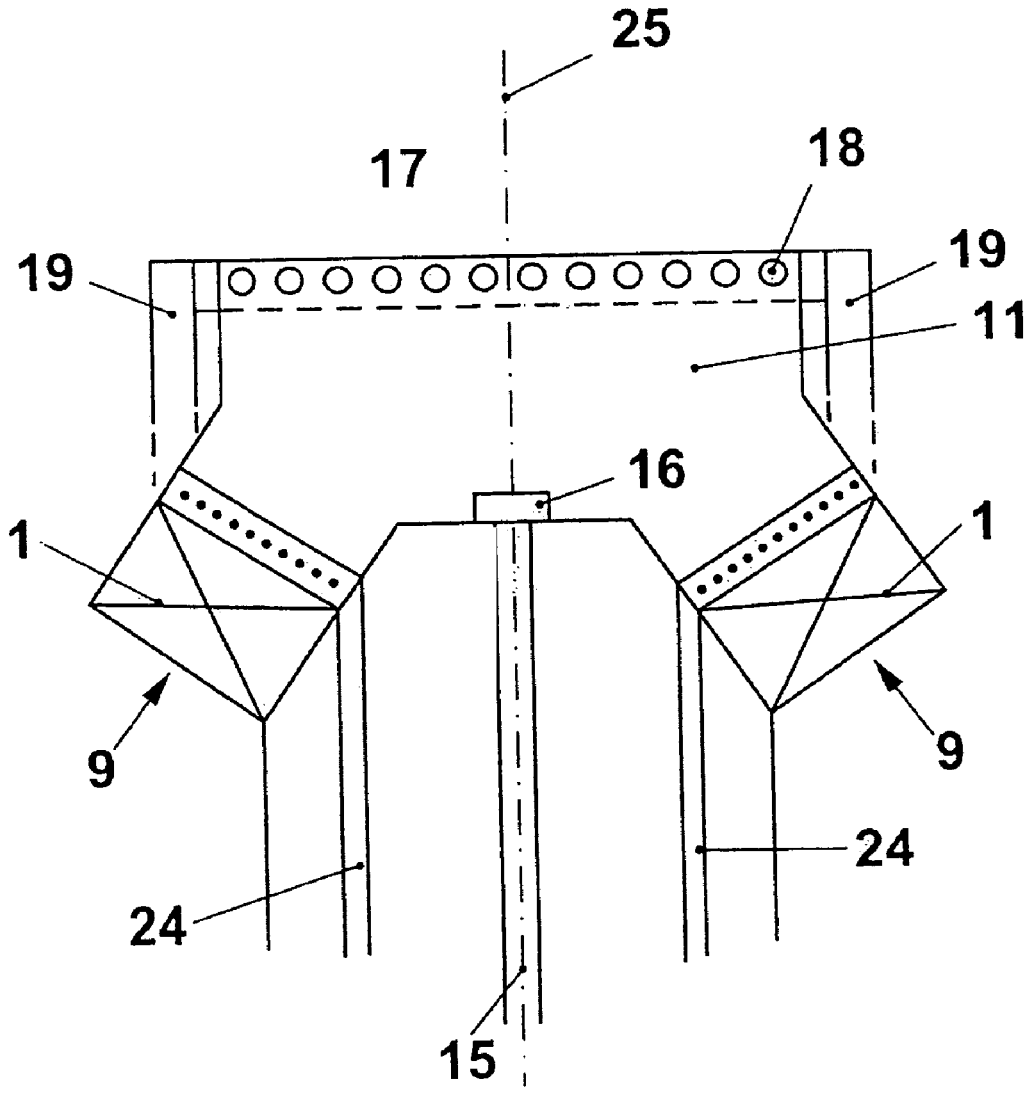
FIG. 7 shows an example of a further possible configuration of the burner.

Finally, FIG. 7 also shows an example of a burner in which the swirl generator 1 is designed as a swirl grating, by means of which incoming combustion air 9 is swirled up. An additional fuel for premix loading can be introduced into the combustion air 9 via the feed lines 24 leading to outlet openings in the region of the swirl generator 1. The pilot fuel 15 is supplied via a nozzle 16 which projects centrally into the internal volume 11. In this burner too, the outlet openings 18 for the synthesis gas are arranged distributed around the burner axis 25 at the combustion chamber-side end of the inner volume 11 and are supplied with synthesis gas via the fuel feed passages 19.

Although the invention has been presented primarily on the basis of a double-cone burner of the type which is known from EP 321 809, the person skilled in the art will readily recognize that the invention can also be applied to other types of burner and swirl generator geometries, as known, for example, from EP 780 629 or WO 93/17279. Of course, modifications to these burner geometries are also possible, provided that the purpose of the swirl generator, i.e. that of generating a swirling combustion air flow, is still ensured.

What is claimed is:

1. A burner comprising a swirl generator unit and means for introducing fuel into a combustion air stream, the swirl generator unit comprising a swirl generator having at least one combustion-air inlet opening for the combustion air stream, and surrounding an internal swirl space, and the means for introducing fuel comprising at least one first fuel feed having a group of first fuel outlet openings arranged radially outside the swirl generator unit proximate an exit of the swirl space, wherein the swirl generator unit, at a combustion chamber-side end, has at least one inlet opening that at least partially surrounds periphery of the swirl generator unit, and wherein the fuel outlet openings in the region of the inlet opening are arranged radially outside the swirl generator unit so that fuel communicates with the internal swirl space through the inlet opening.

2. The burner of claim 1, wherein the group of first fuel outlet openings is arranged in a row around a burner axis.

3. The burner of claim 1, wherein outlet passages formed by the first fuel outlet openings are disposed along passage axes and are arranged at an angle such that the passage axes intersect at a point on a burner axis downstream of the burner.

4. The burner of claim 1, wherein outlet passages formed by the first fuel outlet openings are disposed along passage axes and are arranged at angles with respect to a burner axis such that the passage axes of different subgroups of the first fuel outlet openings intersect at various points downstream of the burner.

5. The burner of claim 1, wherein the swirl generator and the at least one first fuel feed are formed of the same material and are coupled together.

6. The burner of claim 1, wherein the fuel feeds are connected to the swirl generator unit via connecting lugs.

7. The burner of claim 6, wherein the fuel feeds are connected to the swirl generator unit only at the combustion chamber-side end of the swirl generator unit.

8. The burner of claim 1, wherein a fuel lance projects from a side of the swirl generator unit that is remote from the combustion chamber toward the internal swirl space and is arranged on a burner axis.

9. The burner of claim 1, wherein at least one second fuel feed having a group of second fuel outlet openings is arranged substantially along a direction of a burner axis, and is provided at the swirl generator.

10. The burner of claim 9, wherein the at least one first fuel feed is configured with a cross-section permitting volumetric flow to be several times higher than in the at least one second fuel feed.

11. The burner of claim 9, wherein an inner body is arranged in an internal volume of the burner, the second fuel outlet openings of at least one second fuel feed being arranged on the inner body substantially along a direction of a burner axis.

12. The burner of claim 1, wherein the at least one combustion-air inlet opening comprises tangential inlet slots.

13. The burner of claim 1, wherein the at least one combustion-air inlet opening comprises tangential inlet slots disposed substantially in the direction of a burner axis.

14. The burner of claim 13, wherein a second fuel feed having a group of second fuel outlet openings is arranged along each inlet slot.

15. The burner of claim 1, wherein the at least one inlet opening comprises a slot.

16. The burner of claim 1, wherein the swirl generator and the at least one first fuel feed are castings of the same material and are coupled together.

17. A gas turbine comprising:

at least one burner comprising a swirl generator unit and means for introducing fuel into a combustion air stream, the swirl generator unit comprising a swirl generator having at least one combustion-air inlet opening for the combustion air stream, and surrounding an internal swirl space, and the means for introducing fuel comprising at least one first fuel feed having a group of first fuel outlet openings arranged radially outside the swirl generator unit proximate an exit of the swirl space, wherein the swirl generator unit, at a combustion chamber-side end, has at least one inlet opening that at least partially surrounds periphery of the swirl generator unit, and wherein the fuel outlet openings in the region of the inlet opening are arranged radially outside the swirl generator unit so that fuel communicates with the internal swirl space through the inlet opening.

18. The burner of claim 17, wherein the swirl space is conical.

19. The burner of claim 1, wherein the swirl space is conical.

* * * * *